United States Patent [19]

Tomita et al.

[11] Patent Number: 4,931,374

[45] Date of Patent: Jun. 5, 1990

[54] ELECTROPHOTOGRAPHIC POSITIVE CHARGING TONER CONTAINING A COPPER PHTHALOCYANINE BLUE PIGMENT

[75] Inventors: Masami Tomita, Numazu; Toshiyasu Kawabata, Shizuoka; Toshiki Nanya; Hisao Murayama, both of Numazu, all of Japan

[73] Assignee: Ricoh Company, Ltd., Tokyo, Japan

[21] Appl. No.: 739,614

[22] Filed: May 31, 1985

[30] Foreign Application Priority Data

Jun. 6, 1984 [JP] Japan ..... 59-114442

[51] Int. Cl.[5] ..... G03G 9/08

[52] U.S. Cl. ..... 430/106; 430/109

[58] Field of Search ..... 430/110, 106, 109

[56] References Cited

U.S. PATENT DOCUMENTS 3,547,822 12/1970 Miller ..... 430/106.6

4,254,205 3/1981 Lu et al. ..... 430/122

*Primary Examiner*—J. David Welsh

*Attorney, Agent, or Firm*—Oblon, Spivak, McClelland, Maier & Neustadt

[57] ABSTRACT

A toner for developing latent electrostatic images is disclosed which comprises a binder agent and $\epsilon$-type copper phthalocyanine blue pigment which serves as coloring agent and positive polarity controlling agent.

8 Claims, No Drawings

ELECTROPHOTOGRAPHIC POSITIVE CHARGING TONER CONTAINING A COPPER PHTHALOCYANINE BLUE PIGMENT

BACKGROUND OF THE INVENTION

The present invention relates to an electrophotographic positive charging toner which comprises a resin as the main component and ϵ-type copper phthalocyanine blue pigment.

Many of conventional toners deteriorate in the course of repeated and continuous use for development of latent electrostatic images due to the collision between toner particles and carriers and due to the mutual deterioration of toner particles, carriers and the surface of a photoconductor which is caused by the friction between them, so that the density of developed images changes while in use and fogging density at the background of the images is intensified. As a result, the copy image quality is degraded. Further, in the case of such conventional toners, if it is tried to increase the developed image density by increasing the toner deposition on the surface of the photoconductor, the background density also increases, so that the so-called fogging takes place.

Resins and coloring agents are known which have high polarity controlling performance and therefore are considered to be effective for eliminating the above mentioned shortcomings of the conventional toners. However, they have their particular shortcomings. In particular, a pigment that has high polarity controlling performance and can be suitably employed in a blue toner is not known.

SUMMARY OF THE INVENTION

It is therefore an object of the present invention to provide an electrophotographic positive charging toner from which the above described shortcomings of the conventional toners have been eliminated. This invention is based on the discovery of a coloring agent having high polarity controlling performance. This coloring agent is effective for positive polarity controlling even if a small amount of the coloring agent is employed and the positive polarity controlling performance does not depend upon the kind of a resin used in combination with the coloring agent.

According to the present invention, the above object is attained by an electrophotographic positive charging toner which comprises at least a resin as the main component and an ϵ-type copper phthalocyanine blue pigment.

DETAILED DESCRIPTION OF THE PREFERRED EMBODIMENTS

Conventionally it is known that copper phthalocyanine exists in five polymorphorisms, that is, α-type, β-type, γ-type, δ-type and ϵ-type. These can be easily distinguished one from the other by X-ray diffractiometry. Preparation of these types of copper phthalocyanines is described in Japanese Patent Publication No. 37-12836.

ϵ-type copper phthalocyanine is a highly reddish blue pigment, which is obtained as described in Japanese Patent Publication No. 40-2780 by the steps of (i) melting an excess of urea (3 to 5 times the amount of phthalic anhydride) as compared with the amount of 1 to 2 times the amount of phthalic anhydride employed in the usual condensation reaction with phthalic anhydride or nitrile, (ii) adding phthalic anhydride or phthalonitrile to the melted urea to perform a condensation reaction and then (iii) subjecting the reaction mixture to the salt milling process. The copper phthalocyanine employed in conventional toner is of an ϵ-type.

In the present invention, it is preferable that the ϵ-type copper phthalocyanine be employed in an amount of 0.1 to 20 parts by weight, more preferably in an amount of 3 to 15 parts by weight, in 100 parts by weight of the toner according to the present invention.

As the resins for use in the present invention, any resins for use in the conventional dry type toner can be employed. Usually it is preferable that resins be chosen, with the properties, such as adhesiveness, preservability, fluidity and crushable properties, taken into consideration. It is usually unnecessary to take the polarity controlling properties when choosing the resins.

Specific examples of suitable resins for use in the present invention are epoxy resin, phenolic resin, acrylic resin, styrene resin, styrene-butadiene resin, alkyd resin, wax, rosin, acetal resin, vinylidene resin and maleic resin.

When a non-magnetic toner is employed, it is preferable that the amount of the resin be in the range of 95 to 70 wt. %, and the ϵ-type copper phthalocyanine in the range of 0.1 to 20 wt. %, more preferably in the range of 3 to 15 wt. %, in the toner.

When a magnetic toner is prepared, magnetic materials, alloys and compounds of iron, cobalt, nickel and manganese, such as magnetite, γ-hematite and ferrite, are contained in the toner. When preparing a magnetic toner, it is preferable that the amount of the resin be in the range of 60 to 40 wt. %, the amount of the ϵ-type copper phthalocyanine in the range of 0.1 to 20 wt. %, more preferably in the range of 3 to 15 wt. %, and the amount of the magnetic material in the range of 20 to 50 wt. % in the toner.

Furthermore, additives such as lubricants (for example, teflon and zinc stearate), fluidity providing agent, caking prevention agent, abrasive and electroconductivity providing agent can be employed. It is preferable that the amount of such additives be in the range of 2 to 4 parts by weight to 100 parts by weight of the toner.

Since the ϵ-type copper phthalocyanine has high positive polarity control performance as well as a blue color, it can be effectively used in a blue toner by utilizing its intrinsic blue color.

The electrophotographic positive charging toner according to the present invention can be prepared in a conventional manner. Specifically, the necessary components for this toner are melted and kneaded under application of heat, cooled and crushed to particles. The crushed particles are then classified to obtain toner particles with an appropriate particle size.

By referring to the following examples and comparative examples, the present invention will now be explained in detail.

EXAMPLE 1

A mixture of the following components was kneaded under application of heat in a roll mill.

| | Parts by Weight |
|---|---|
| Polystyrene (Piccolastic D-125 commercially available from Esso Standard) | 85 |
| ϵ-type copper phthalocyanine | 5 |

-continued

| | Parts by Weight |
|---|---|
| Carbon black | 10 |

After the above kneaded mixture was cooled, it was ground to small particles and the particles were classified, so that particles with a particle size ranging from 5 μm to 25 μm were obtained, whereby an electrophotographic positive charging toner No. 1 according to the present invention was obtained. This toner mixed with iron powder sieved through a filter with 150 to 250 meshes, so that a dry-type developer was prepared.

The thus prepared dry-type developer containing the positive charging toner No. 1 was employed for developing latent electrostatic images in a commercially available electrophotographic copying machine (FT-4700 made by Ricoh Company, Ltd.). As a result, clear copy images were obtained and the image quality of the images did not change in the course of extended and repeated use of the toner.

EXAMPLE 2

A mixture of the following components was kneaded under application of heat in a roll mill.

| | Parts by Weight |
|---|---|
| Styrene - acrylic copolymer | 53 |
| Magnetite | 25 |
| Titanium oxide | 15 |
| ε-type copper phthalocyanine | 7 |

After the above kneaded mixture was cooled, it was ground to small particles and the particles were classified, so that particles with a particle size ranging from 4 μm to 10 μm were obtained, whereby an electrophotographic positive charge toner No. 2 according to the present invention was obtained.

The thus prepared positive charge toner No. 2 was employed for developing latent electrostatic images in the same manner as in Example 1. As a result, clear bluish copy images were obtained and the image quality of the images did not change in the course of extended and repeated use of the toner.

COMPARATIVE EXAMPLE 1

Example 2 was repeated except that in the formulation in Example 2, the ε-type copper phthalocyanine was replaced by α-type copper phthalocyanine, whereby a comparative positive toner No. 1 was prepared.

The thus prepared comparative positive charge toner No. 1 was employed for developing latent electrostatic images in the same manner as in Example 1. The result was that considerable deposition of the toner particles was observed on the background of the copy and the image quality was poor.

COMPARATIVE EXAMPLE 2

Example 2 was repeated except that in the formulation in Example 2, the ε-type copper phthalocyanine was replaced by β-type copper phthalocyanine, whereby a comparative positive toner No. 2 was prepared.

The thus prepared comparative positive charge toner No. 2 was employed for developing latent electrostatic images in the same manner as in Example 1. The result was that initially the toner deposition on the background was scarce, but when the number of copies amounted to about 1,000 copies, the toner deposition became considerable, so that the copies could not be used in practice.

EXAMPLE 3

A mixture of the following components was kneaded under application of heat in a roll mill.

| | Parts by Weight |
|---|---|
| Styrene - acrylic copolymer | 55 |
| Magnetite | 20 |
| ε-type copper phthalocyanine | 7 |
| Nigrosine | 3 |

After the above kneaded mixture was cooled, it was ground to small particles and the particles were classified, so that particles with a particle size ranging from 4 μm to 10 μm were obtained, whereby an electrophotographic positive charge toner No. 3 according to the present invention was obtained.

The thus prepared positive charge toner No. 3 was employed for developing latent electrostatic images in the same manner as in Example 1. As a result, clear bluish copy images were obtained and the image quality of the images did not change when about 100,000 copies were made by use of this toner.

What is claimed is:

1. A toner for developing latent electrostatic images comprising a binder resin and an amount of an ε-type copper phthalocyanine blue pigment said binder and pigment being present in sufficient amounts such that said toner can be used for latent electrostatic image development.

2. A toner for developing latent electrostatic images as claimed in claim 1, wherein the content of said ε-type copper phthalocyanine blue pigment in said toner is in the range of 0.1 to 20 wt. %.

3. A toner for developing latent electrostatic images as claimed in claim 1, wherein said binder resin is selected from the group consisting of epoxy resin, phenolic resin, acrylic resin, styrene resin, styrene-butadiene resin, alkyd resin, wax, rosin, acetal resin, vinylidene resin and maleic resin.

4. A toner for developing latent electrostatic images comprising a binder resin in an amount ranging from 95 to 70 wt. % and ε-type copper phthalocyanine blue pigment in an amount of 0.1 to 20 wt. %.

5. A toner for developing latent electrostatic images comprising a binder resin in an amount ranging from 60 to 40 wt. %, ε-type copper phthalocyanine blue pigment in an amount of 0.1 to 20 wt. % and a magnetic material in an amount of 20 to 50 wt. %.

6. A toner for developing latent electrostatic images as claimed in claim 5, wherein said magnetic material is selected from the group consisting of magnetite, γ-hematite and ferrite.

7. A toner for developing latent electrostatic images as claimed in claim 4, further comprising an additive selected from the group consisting of a lubricant, a fluidity providing agent, a caking prevention agent and an electroconductivity providing agent, in an amount ranging from 2 to 4 parts by weight to 100 parts by weight of said toner.

8. A toner for developing latent electrostatic images as claimed in claim 5, further comprising an additive selected from the group consisting of a lubricant, a fluidity providing agent, a caking prevention agent and an electroconductivity providing agent, in an amount ranging from 2 to 4 parts by weight to 100 parts by weight of said toner.

* * * * *